US006769189B1

(12) United States Patent
Morello

(10) Patent No.: US 6,769,189 B1
(45) Date of Patent: Aug. 3, 2004

(54) CUE CHALKING AND SCUFFING DEVICE

(76) Inventor: Salvatore D. Morello, 51 Meadowbrook Rd., #22, Ellington, CT (US) 06029

( * ) Notice: Subject to any disclaimer, the term of this patent is extended or adjusted under 35 U.S.C. 154(b) by 161 days.

(21) Appl. No.: 10/057,395

(22) Filed: Jan. 25, 2002

(51) Int. Cl.[7] ..... B27L 9/00
(52) U.S. Cl. ..... 30/494
(58) Field of Search ..... 30/494; 473/35–39

(56) References Cited

U.S. PATENT DOCUMENTS

| | | | | | |
|---|---|---|---|---|---|
| 221,164 | A | * | 11/1879 | Fautz | 473/35 |
| 451,938 | A | * | 5/1891 | Klapperich | 473/38 |
| 3,989,079 | A | | 11/1976 | Treadway | |
| 4,785,586 | A | | 11/1988 | Kratfel | |
| 4,987,936 | A | * | 1/1991 | Calabrese | 144/346 |
| 5,046,728 | A | | 9/1991 | Haddock | |
| 5,129,187 | A | * | 7/1992 | Cain | 451/28 |
| 5,545,093 | A | * | 8/1996 | Contestabile et al. | 473/36 |
| 5,697,852 | A | | 12/1997 | Adelson et al. | |
| 5,865,682 | A | | 2/1999 | Sutton | |

FOREIGN PATENT DOCUMENTS

| | | | | |
|---|---|---|---|---|
| GB | 2176122 A | * | 12/1986 | A63D/15/14 |
| GB | 2356152 A | * | 5/2001 | A63D/15/14 |

* cited by examiner

*Primary Examiner*—Allan N. Shoap
*Assistant Examiner*—Isaac Hamilton
(74) *Attorney, Agent, or Firm*—Sturm & Fix LLP

(57) ABSTRACT

The present invention provides a unitary chalking and scuffing device for a billiard cue. The device includes a block of billiard chalk with a face of exposed chalk and with at least one of the other faces carrying a scuffing surface. In one embodiment of the invention, the block has one face of exposed chalk and five faces that carry sandpaper to scuff the tip of the billiard cue so the chalk will adhere.

1 Claim, 1 Drawing Sheet

CUE CHALKING AND SCUFFING DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of billiard accessories, and more particularly to a billiard cue chalking and scuffing device.

2. Description of Related Art

Millions of people all over the world play billiards. Whether it's pool, bumper pool, snooker or eight ball, these sports use a billiard cue which carries a tip that requires chalk be applied periodically. Basically, every time the player shoots at the pool balls they need to chalk the cue tip with the chalk. Also, a main part of having the chalk stick to the cue tip is that it must be scuffed with a scuffer. It is very distracting and annoying, especially during a match, if the player needs to go into their bag or to another area to scuff their cue tip.

As can be seen by reference to the following U.S. Pat. Nos. 3,989,079; 4,785,586; 5,046,728; 5,697,852 and 5,865,682, the prior art is replete with myriad and diverse cue tip treatment devices. While all of the aforementioned prior art constructions are more than adequate for the basic purpose and function for which they have been specifically designed, they are uniformly deficient with respect to their failure to provide a simple, efficient, and practical unitary chalking and scuffing device for a billiard cue.

As a consequence of the foregoing situation, there has existed a longstanding need for a new and improved chalking and scuffing device and the provision of such a construction is a stated objective of the present invention.

BRIEF SUMMARY OF THE INVENTION

Briefly stated, the present invention provides a unitary chalking and scuffing device for a billiard cue. The device includes a block of billiard chalk with a face of exposed chalk and with at least one of the other faces carrying a scuffing surface. In one embodiment of the invention, the block has one face of exposed chalk and five faces that carry sandpaper to scuff the tip of the billiard cue so the chalk will adhere.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
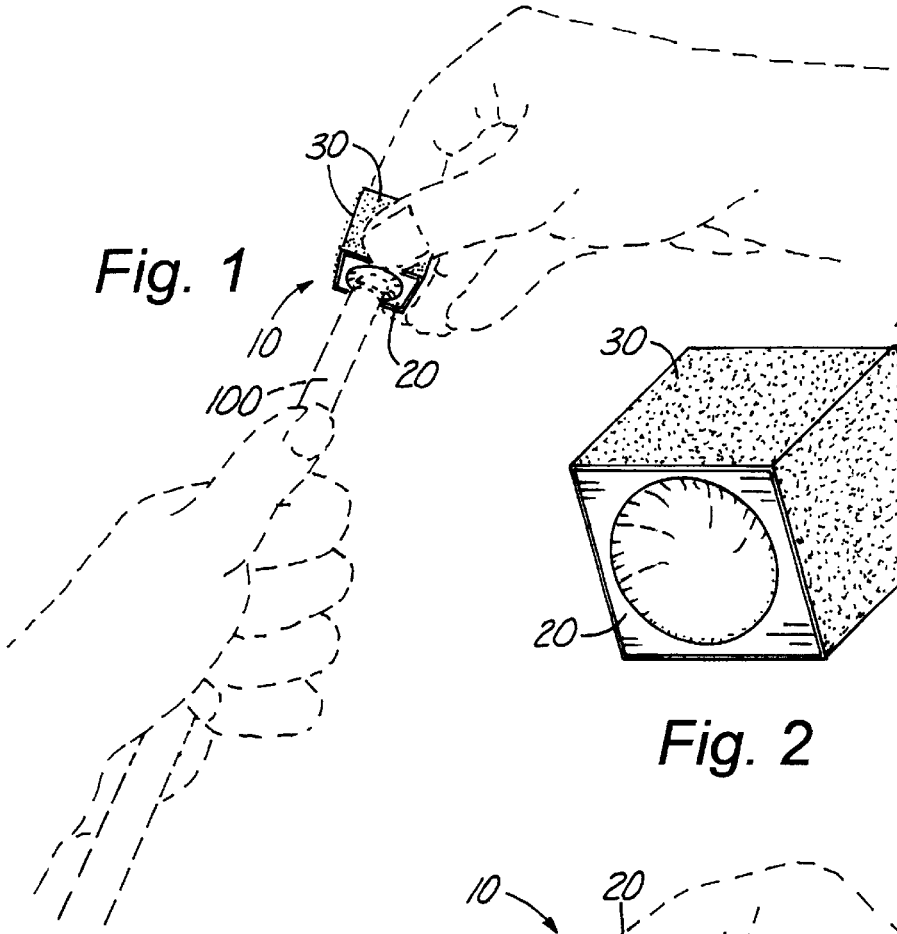
FIG. 1 is a perspective view showing the unitary chalking and scuffing device of the present invention being used to chalk the tip of a billiard cue.
Figure 2:
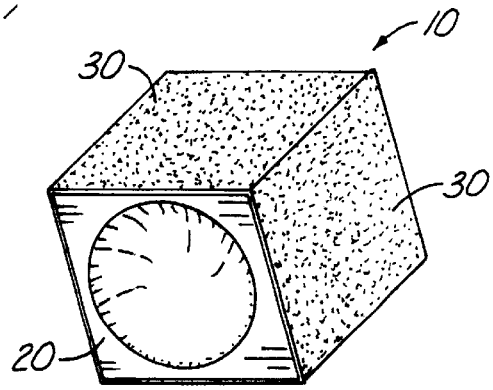
FIG. 2 is an enlarged perspective view of the unitary chalking and scuffing device.

As can be seen by reference to the drawings, and in particularly to FIG. 1, the unitary chalking and scuffing device that forms the basis of the present invention is designated generally by the reference number 10. The device 10 comprises a block of billiard chalk having the six faces of a cube. The first face 20 is exposed chalk while the five remaining faces 30 carry a scuffing surface such as sandpaper. It is to be understood that the scuffing surface could be some material other than sandpaper so long as it provides an abrasive surface to scuff the cue tip. Also, it is to be understood that the scuffing surface may be carried on fewer than all of the five faces 30.

Figure 3:
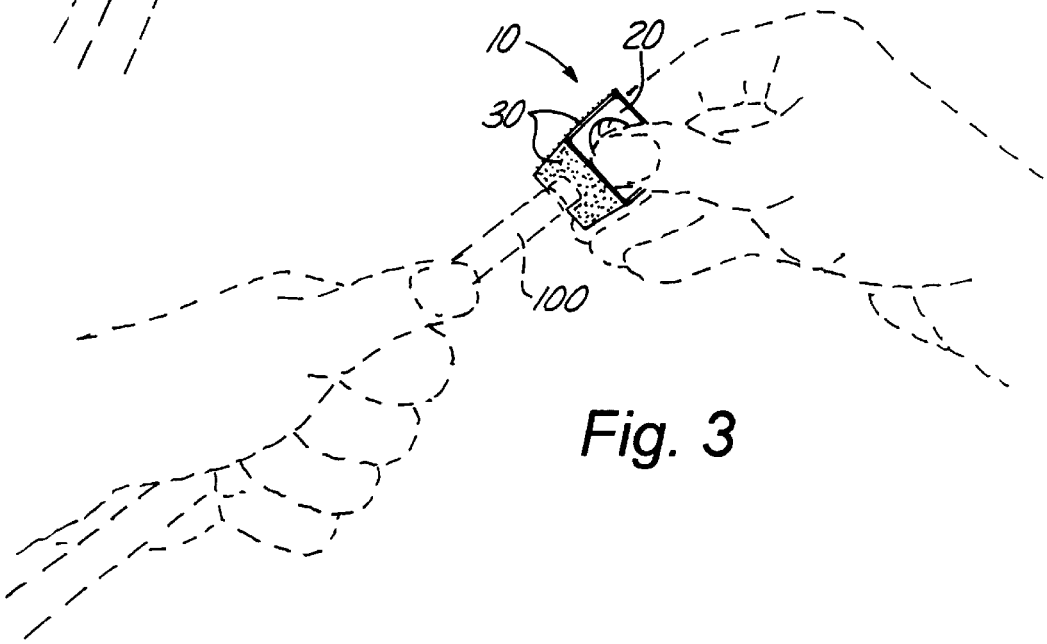
FIG. 3 is a perspective view similar to FIG. 1, but showing the unitary chalking and scuffing device being used to scuff the tip of a billiard cue to prepare it for chalking.

Use of the unitary chalking and scuffing device 10 is illustrated in FIG. 1 where the player applies chalk to the tip of the cue 100 with the exposed chalk of the first face 20, and in FIG. 3 where the player scuffs the tip of the cue 100 with the sandpaper on one of the five remaining faces 30.

The unitary device 10 makes it easy and convenient for the player to scuff and chalk the tip of the cue 100 before each shot, thus minimizing the possibility of miscuing.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A chalking and scuffing device for a billiard cue consisting of:

a rectangular block of billiard chalk having a first face of exposed chalk and five other faces that are completely covered with a scuffing surface comprising a single layer of sandpaper.

* * * * *